US011015315B2

(12) United States Patent
Chin et al.

(10) Patent No.: US 11,015,315 B2
(45) Date of Patent: May 25, 2021

(54) PILE SET MEASUREMENT APPARATUS

(71) Applicants: Yeow Thium Chin, Singapore (SG); Jia Yi Chin, Singapore (SG)

(72) Inventors: Yeow Thium Chin, Singapore (SG); Jia Yi Chin, Singapore (SG)

( * ) Notice: Subject to any disclaimer, the term of this patent is extended or adjusted under 35 U.S.C. 154(b) by 0 days.

(21) Appl. No.: 15/767,872

(22) PCT Filed: Oct. 12, 2015

(86) PCT No.: PCT/SG2015/050385
§ 371 (c)(1),
(2) Date: Apr. 12, 2018

(87) PCT Pub. No.: WO2017/065686
PCT Pub. Date: Apr. 20, 2017

(65) Prior Publication Data
US 2018/0298580 A1 Oct. 18, 2018

(51) Int. Cl.
*E02D 13/06* (2006.01)
*E02D 5/22* (2006.01)
*E02D 13/04* (2006.01)

(52) U.S. Cl.
CPC ..... *E02D 13/06* (2013.01); *E02D 5/22* (2013.01); *E02D 13/04* (2013.01)

(58) Field of Classification Search
CPC ..... E02D 13/06; E02D 13/04; E02D 5/22
USPC ..... 73/11.3
See application file for complete search history.

(56) References Cited

U.S. PATENT DOCUMENTS 3,498,388 A * 3/1970 Jovis ..... E02D 13/06 173/2
4,158,919 A * 6/1979 McMurtry ..... G01B 7/012 33/505
4,187,614 A * 2/1980 Abiru ..... G01B 5/012 33/23.11
4,457,073 A * 7/1984 Payne ..... G01B 5/207 33/544.3
4,660,655 A * 4/1987 Wilner ..... E02D 7/08 173/82
5,189,806 A * 3/1993 McMurtry ..... G01B 21/04 33/503

(Continued)

FOREIGN PATENT DOCUMENTS

JP 411007 1/1966
JP 55807 5/1974

(Continued)

OTHER PUBLICATIONS

English Abstract of JP 55807.

(Continued)

*Primary Examiner* — Marrit Eyassu
(74) *Attorney, Agent, or Firm* — Preston Smirman; Smirman IP Law, PLLC

(57) ABSTRACT

An apparatus (100) to trace pile set during pile driving comprises a panel (110) for attachment to a pile (150); a holding mechanism (120) to hold a writing instrument (160) against the panel (110) to trace the pile set for series of blows during the pile driving; a sliding mechanism (130) to provide lateral movement across the panel (110) for the holding mechanism (120) after each blow during the pile driving; and a platform (140) to allow the sliding mechanism (130) to slide freely in horizontal direction.

9 Claims, 6 Drawing Sheets

(56) References Cited

U.S. PATENT DOCUMENTS

| | | | | |
|---|---|---|---|---|
| 5,303,162 | A | 4/1994 | Yoon | |
| 6,301,551 | B1 * | 10/2001 | Piscalko | E02D 13/06 340/853.8 |
| 6,441,910 | B1 * | 8/2002 | Christoph | G01B 11/007 250/559.29 |
| 6,533,502 | B2 * | 3/2003 | McVay | E02D 13/06 340/853.8 |
| 7,156,188 | B2 * | 1/2007 | Bermingham | E02D 7/02 173/128 |
| 8,522,891 | B2 * | 9/2013 | Heichel | E02D 7/18 173/162.1 |
| 8,763,719 | B2 * | 7/2014 | White | E02D 7/125 173/1 |
| 2006/0213279 | A1 * | 9/2006 | Choi | E02D 33/00 73/786 |
| 2007/0074881 | A1 * | 4/2007 | Bermingham | E02D 7/02 173/2 |
| 2008/0189969 | A1 * | 8/2008 | Fuchs | G01B 21/045 33/503 |

FOREIGN PATENT DOCUMENTS

| | | | | |
|---|---|---|---|---|
| JP | 4948111 | | 5/1974 | |
| JP | 129936 | | 8/1984 | |
| JP | 60212518 | A * | 10/1985 | E02D 13/06 |
| JP | 11293674 | A * | 10/1999 | |
| JP | 2011122313 | A * | 6/2011 | |
| KR | 1020070073035 | | 7/2007 | |

OTHER PUBLICATIONS

English Abstract of JP 129936.
English Abstract of JP 4948111.
English Abstract of KR 1020070073035.
International Search Report dated Dec. 15, 2015.
Written Opinion of the International Searching Authority dated Dec. 3, 2015.
International Preliminary Report on Patentability dated Apr. 17, 2018.
Applicant's Comments on Written Opinion of the International Searching Authority dated Apr. 11, 2016.

* cited by examiner

PILE SET MEASUREMENT APPARATUS

CROSS-REFERENCE TO RELATED APPLICATION

The instant application is a national phase of PCT International Patent Application Serial No. PCT/SG2015/050385 filed Oct. 12, 2015, the entire specification of which is expressly incorporated herein by reference.

FIELD OF THE INVENTION

The present invention relates to an apparatus for tracing pile set during pile driving, and more particularly it relates to such apparatus which allows the pile set to be taken directly and accurately at a safe distance away from a pile.

BACKGROUND OF THE INVENTION

The conventional method of taking final set and temporary compression of a driven pile is performed manually by a worker squatting in front of a pile during last ten blows of pile driving. This manual method is currently used in many countries, although it may pose potential hazard to the worker from falling objects and high noise. It is still used today because there is no alternative measurement device.

Therefore, there is a need for an apparatus for measurement to be taken directly and accurately at a safe distance from the pile. The present invention provides such apparatus.

SUMMARY OF THE INVENTION

The present invention provides an apparatus to trace pile set during pile driving comprises a panel attached to a pile during driving of the pile; a holding mechanism to hold a writing instrument against the panel to trace the pile set; a sliding mechanism to provide lateral movement across the panel during the pile driving; and a platform to allow the sliding mechanism to slide freely in horizontal direction.

The holding mechanism is preferably controlled to rotate to and fro horizontally via a remote controller.

The holding mechanism is also preferably controlled to move transversely (parallel to the panel) to and fro at a distance via the remote controller.

Alternatively, movement of the holding mechanism and the sliding mechanism may be automatic via a pressure sensor and a vibration sensor installed in the apparatus.

Preferably the apparatus includes a LCD monitor to display movement of the writing instrument via a video camera located behind the holding mechanism.

In one embodiment of the present invention provides a method to trace pile set during driving of the pile comprises steps to: attach a panel to a pile; clamp a platform to a stable beam for supporting a sliding mechanism to accommodate a holding mechanism to hold a writing instrument against the panel; position the sliding mechanism over the platform at the extreme left position; and adjust the holding mechanism fixed on the sliding mechanism to trace the pile set for series of blows during the pile driving.

DESCRIPTION OF PREFERRED EMBODIMENTS

The invention will now be described in greater detail, by way of example with reference to the diagrams in which.

Figure 1:
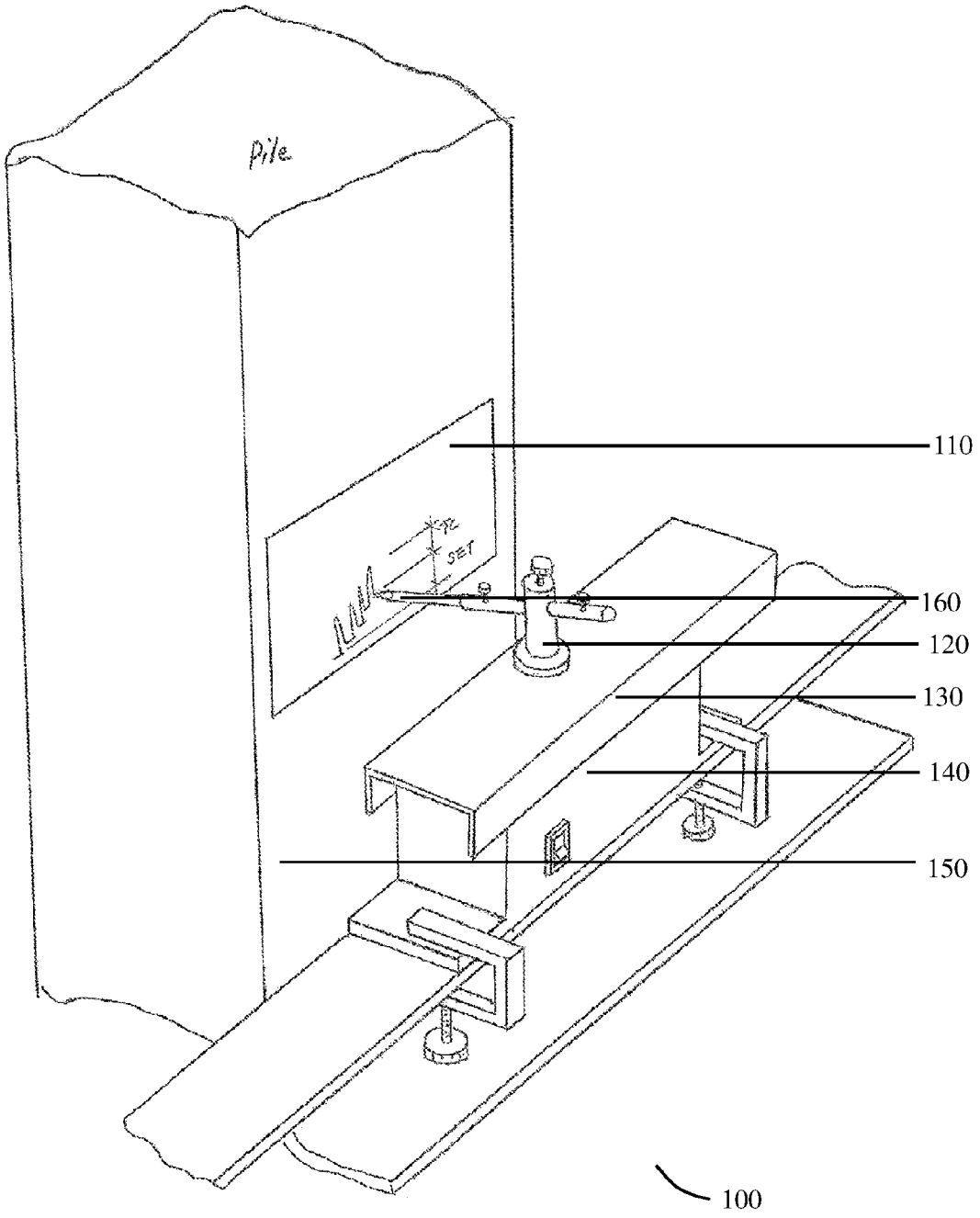
FIG. 1 illustrates the apparatus for pile set measurement.

As shown in FIG. 1 illustrating the apparatus includes a panel (110), a holding mechanism (120), a sliding mechanism (130) and a platform (140). The panel (110) is attached on the face of a pile (150) to show the trace sets per blow during the pile driving. Panel (110) is a sheet of graph paper secured to the pile by adhesive tape. The X and Y axis of the graph paper represents number of blow, pile set and temporary compression of the pile (150) respectively, during the pile driving.

The holding mechanism (120), holds the writing instrument (160) close to the pile (150) to trace the sets per blow, further comprises a holding tube (121), a top rotating means and the writing instrument (160). The holding tube (121) secures the writing instrument (160) firmly and at different lengths by adjusting two screws (121' & 121"). The top rotating means is a top cylindrical block (122) with a hole, where the holding tube (121) slides into the hole of the top cylindrical block (122) and secured by a screw (121"'). The writing instrument (160) can be a pencil, a pen, a marker or any other writing instrument. The top cylindrical block (122) can be controlled to rotate 90° to and fro horizontally and transversely or parallel to the graph paper (110) at a distance via remote controller. Alternatively, the top cylindrical block (122) can also be controlled automatically.

Figure 5:
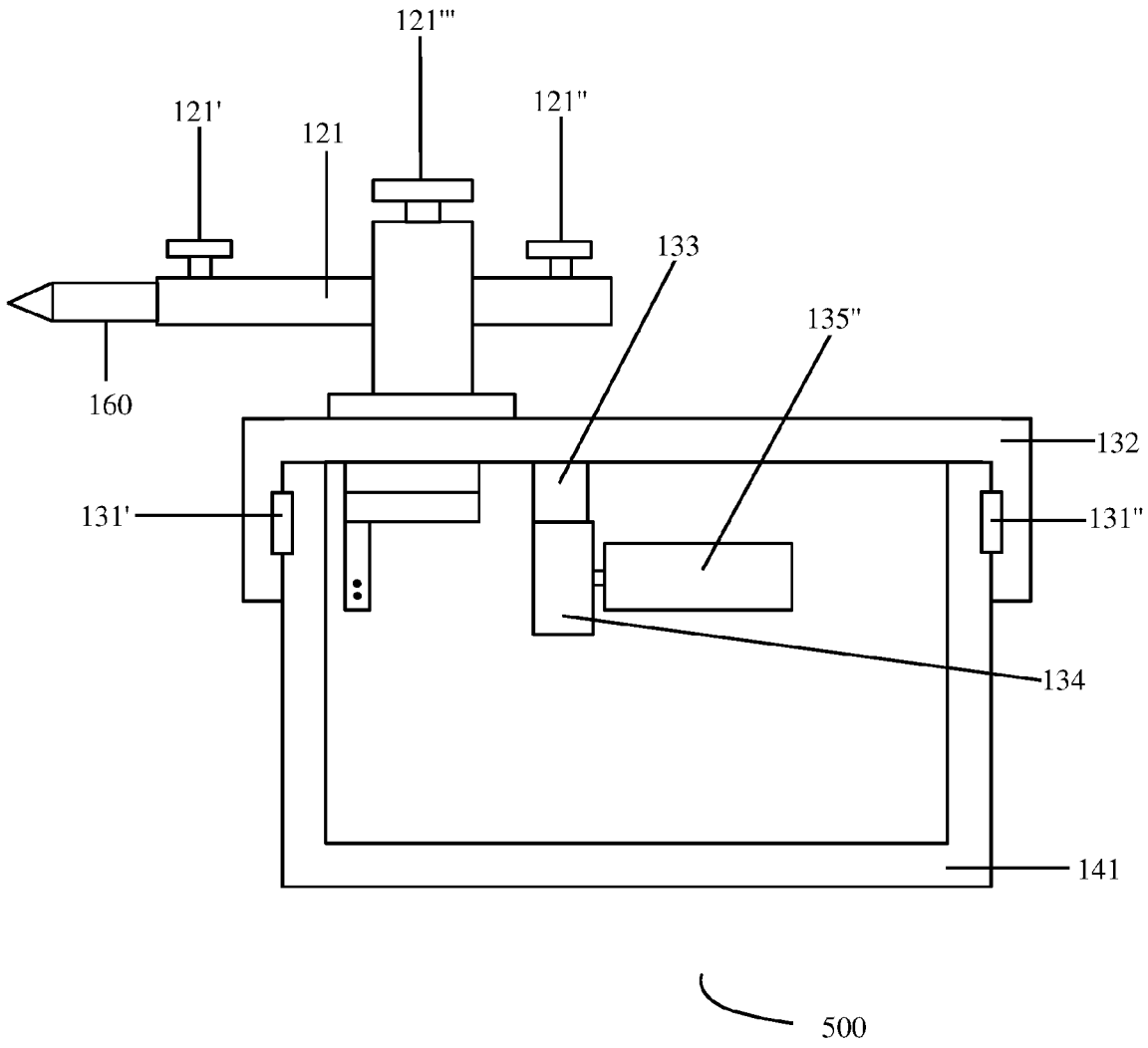
FIG. 5 illustrates the working of the sliding mechanism.

The sliding mechanism (130) comprises a cover plate (132) secured to the platform (140) by two interlocking strips (131' & 131") as shown in FIG. 5, allows the cover plate (132) to slide freely to and fro on the top of the platform (140). The holding mechanism (120) is fixed on the cover plate (132) and provides lateral movement for the holding mechanism (120) to move across the panel (110) to trace pile set for each blow.

The platform (140) is a casing preferably a rectangular casing which holds the cover plate (132) by two interlocking strips (131' & 131"). These strips (131' & 131") allow the cover plate (132) to slide freely to and fro on the top of the casing (141) with very little free movement in other directions. While taking measurement, the casing (141) is fixed or clamped to a horizontal stable beam.

Figure 2:
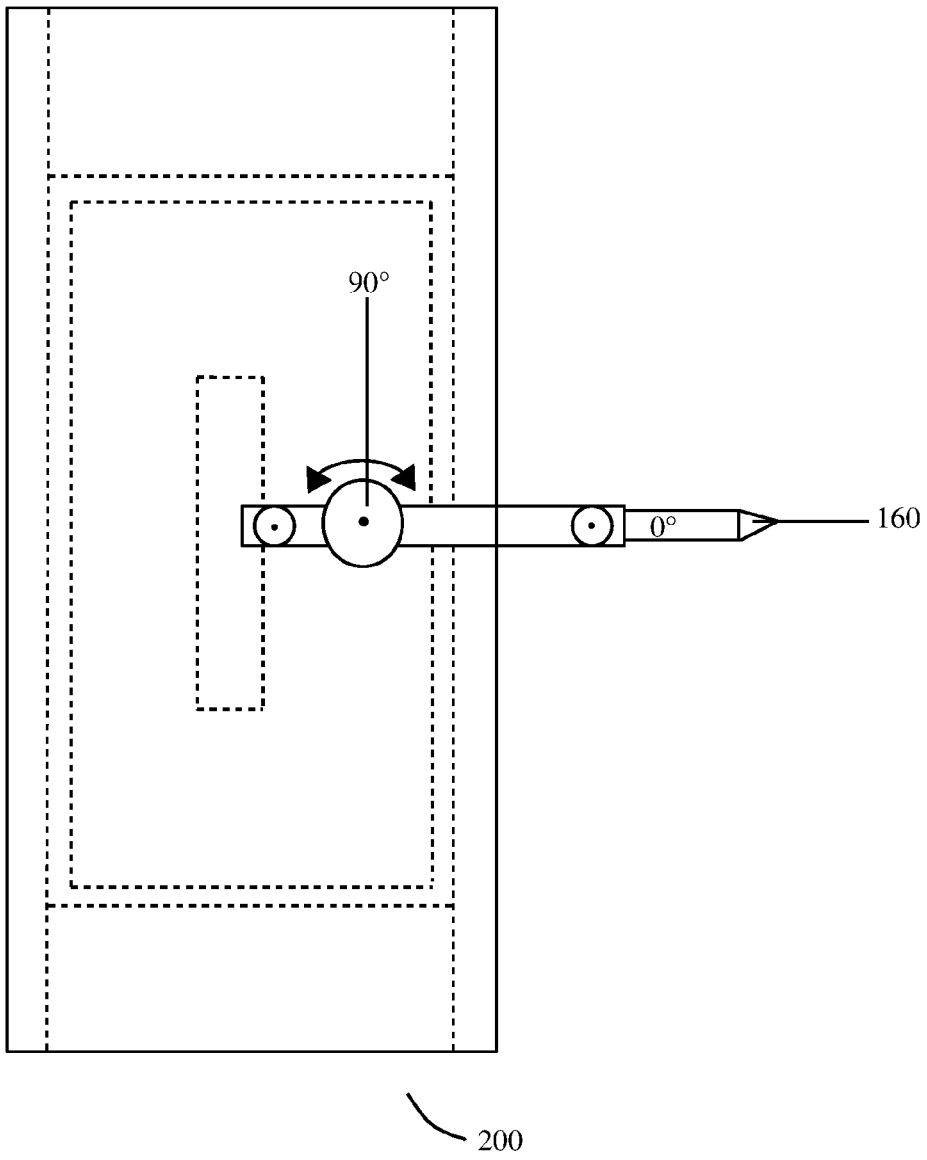
FIG. 2 illustrates the top view of the holding mechanism.

As shown in FIG. 2, in one embodiment the holding mechanism (120) is provided with rotating means, allows the holding mechanism (120) to rotate horizontally from 0° to 90°. When the holding mechanism (120) is at 0° angle, shows the writing instrument (160) is perpendicular to the panel (110) and at 90° angle, shows the writing instrument (160) is parallel to the panel (110). The working of the holding mechanism (120) with rotating means is further explained with reference to FIG. 6.

Figure 3:
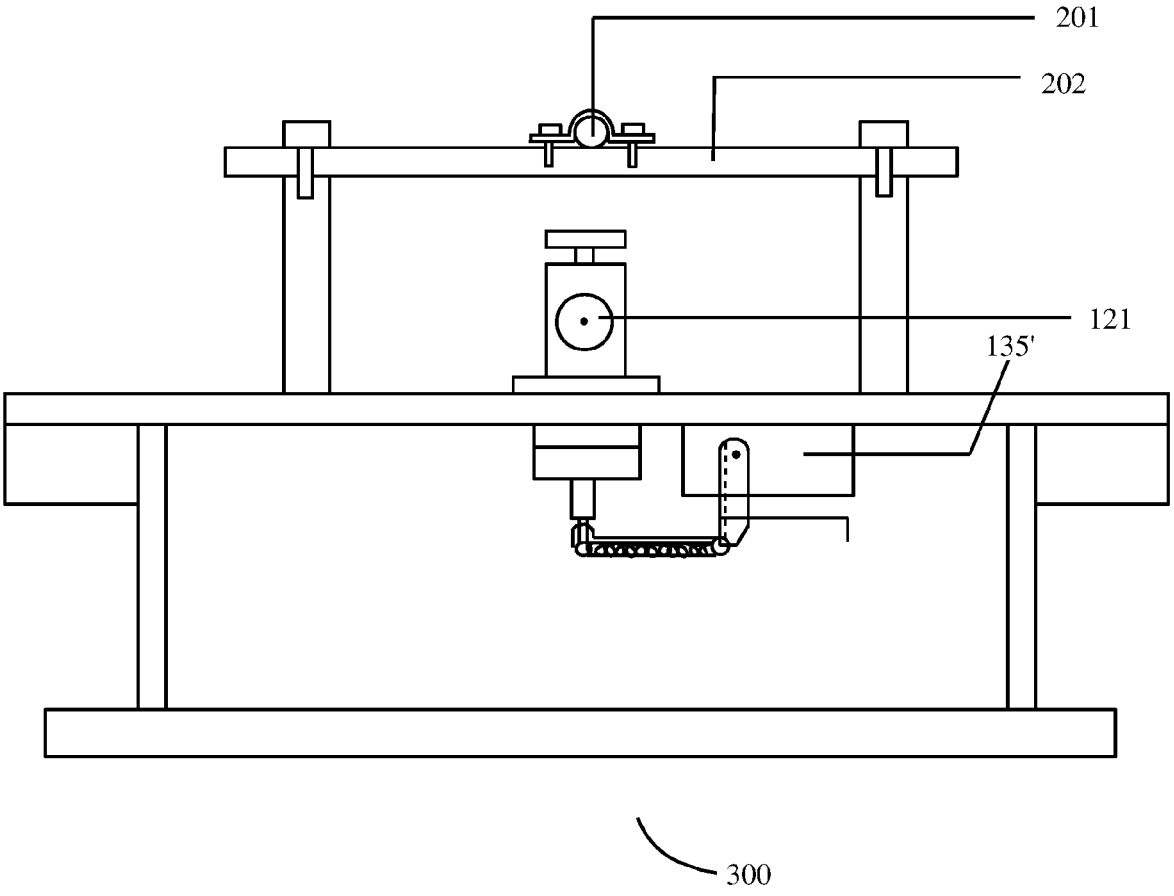
FIG. 3 illustrates the elevation sectional view of types of holding mechanisms.

In an alternative embodiment, as shown in FIG. 3, an alternative type of holding mechanism (120) is fixed at 0° only, the writing instrument (160) is moveable with the holding tube (201) when used. The holding tube (201) is fixed on a rigid structure (202) to provide strong support to the holding tube (201). The rigid structure (202) is attached on the cover plate (132) of the sliding mechanism (130) so that holding tube (201) moves across the panel (110). The writing instrument (160) is a spring loaded writing instrument to accommodate the movement of the pile (150).

Figure 4:
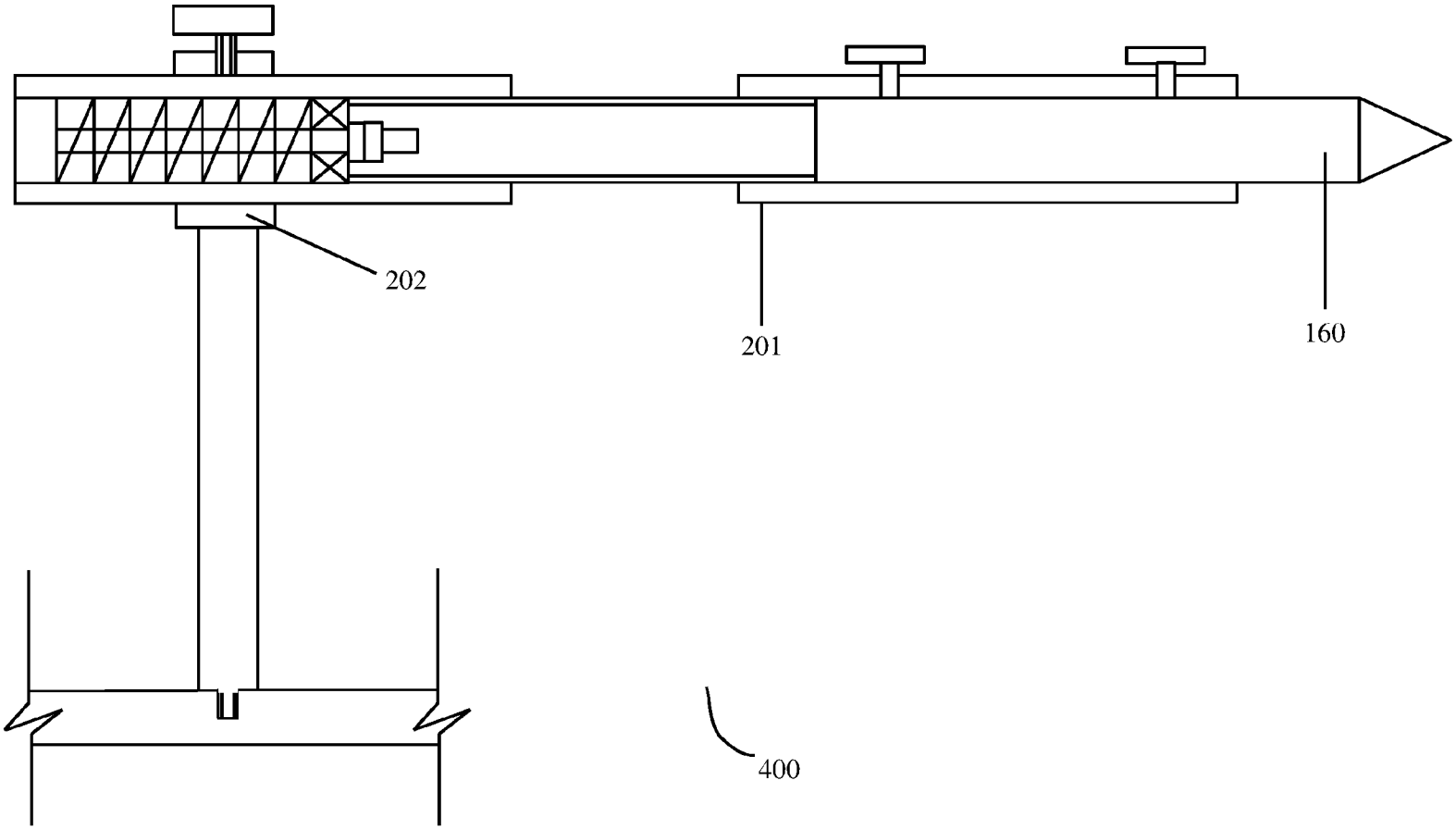
FIG. 4 illustrates the details of the spring loaded holding tube.

As shown in FIG. 4, in one embodiment the holding tube (201) is a spring loaded holding tube to accommodate movement of the pile (150). The spring load mechanism is attached at one end of the holding tube (201) and the writing instrument (160) is fixed to the other end of the holding tube (201) by means of screws. The spring load mechanism pushes the writing instrument (160) against the panel (110). It adds suitable pressure at point of contact between tip of the writing instrument (160) and the panel (110) causing minimal damage to the writing instrument (160) during the pile driving. The holding tube (201) is fixed on the rigid structure (202) to provide support to the holding tube (201). In the preferred embodiment the holding tube (121) is without spring loaded mechanism. The holding tube (121) is a tube for holding the writing instrument (160) firmly by just adjusting with the screws at different lengths.

As shown in FIG. 5, in one embodiment the apparatus can be controlled by worker away from the pile (150) through the remote controller. The remote controller comprises a transmitter & its control sticks, a Liquid Crystal Display (LCD) monitor & its receiver, and batteries. One of the control stick provides the rotational movement of the writing instrument (160) and another control stick provides the transverse movement of the cover plate (132). The holding mechanism (120) is fixed on the cover plate (132) further includes a rack gear (133) and a micro-motor (135') is fixed into a bracket beneath the cover plate (132). This arrangement provides the rotational movement of the writing instrument (160) when the corresponding control stick on the transmitter is moved up or down. The orientation of the rack gear (133) can be facing downwards or sideways. The transverse movement of the cover plate (132) is provided by the rack gear (133) and the movement of the rack gear (133) is controlled by the spur gear (134) which is connected to the micro-motor (135"). The micro-motor (135") is fixed into another bracket on the wall of the casing (141). This arrangement provides the transverse movement of the cover plate (132) when the corresponding control stick is moved up or down. The movement of the cover plate (132) is controlled by the micro-motor (135") through the rotation of the spur gear (134) which pushes the rack gear (133) and the cover plate (132) to move horizontally along the two interlocking strips (131' & 131"). The micro-motor (135") mounted on the bracket, allows the motor to be adjusted so that the spur gear (134) will turn below the connected rack gear (133) smoothly. Both mirco-motors (135' & 135") can be installed and replaced easily. The degree of rotation of the spur gear (134) in both direction is controlled by one of the control stick of the remote controller. The movement of the cover plate (132) and the holding mechanism (120) can be seen in real time via a camera located nearby. The micro-motors (135' & 135") are connected to a battery operated receiver which receives signal from the remote controller to control the movement of the cover plate (132) and the holding mechanism (120). The viewing angle of the LCD monitor can be rotated from horizontal position to vertical position. The monitor receives real time video from the remote transmitter and a camera located on tripod near to the holding mechanism (120). The casing with tripod mounting houses the camera and its transmitter together with their batteries.

In an alternative embodiment, the movement of the holding mechanism (120) and the cover plate (132) works automatically. A pressure sensor and a vibration sensor is installed in apparatus to transmit information back to a computerized remote controller. The pressure sensor is installed in the spring load to pick up pressure applied in the rod and to communicate with the remote controller to control rotation of the writing instrument (160). In order to control the transverse movement of the writing instrument (160) the vibration sensor is installed beneath the cover plate (132) to communicate with the remote controller to slide the cover plate (132) transversely each time after each blow.

Figure 6:
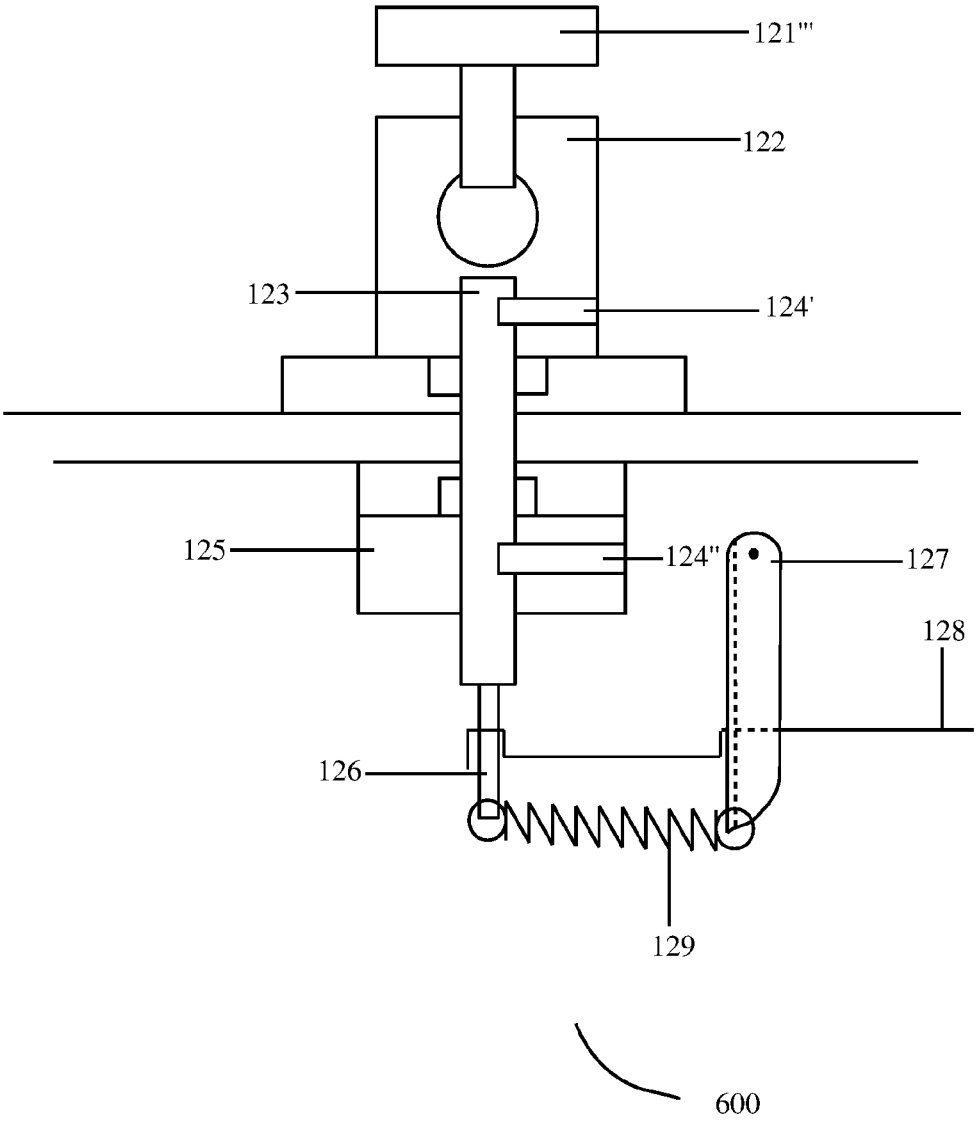
FIG. 6 illustrates the one embodiment of the holding mechanism with rotating means.

Referring to FIG. 6, illustrates the holding mechanism (120) further comprises, the top cylindrical block (122), a bottom cylindrical block (125), a shaft (123), a spring (129), a motor controlled arm (127), a rod (128), and a rotatable lever arm (126). The writing instrument (160) is secured to the holding tube (121) by the two screws (121' & 121"). The holding tube (121) slides into the hole of the top cylindrical block (122) and it is secured by the screw (121"'). The top cylindrical block (122) is secured to the shaft (123) by the screws (124') to hold in position by top and bottom bearings for smooth rotation in both directions. The bottom cylindrical block (125) is secured to bottom of the shaft (123) by the screw (124") to ensure minimal vertical movement of the holding tube (121).

Rotatable lever arm (126) is secured to the bottom cylindrical block (125) by the screw which holds the rotatable lever arm (126) in place for rotation in horizontal plane. The top end of the rotatable lever arm (126) is inserted into bottom cylindrical block (125) which holds the rotatable lever arm (126) from dropping out by a clocking screw to hang the rotatable lever arm (126) in place. It does not restrict the rotatable lever arm (126) from rotation when it is pushed and pulled by the rod (128) and the spring (129). The rotatable lever arm (126) is linked to the motor controlled arm (127) by the rod (128) and the spring (129). The one end of the rod (128) is connected to a upper hole of the rotatable lever arm (126), whereas the other end of the rod (128) is connected to a upper hole of the motor controlled arm (127). Likewise, the one end of the spring (129) is connected to a lower hole of the rotatable lever arm (126), whereas the other end of the spring (129) is connected to a lower hole of the motor controlled arm (127). The upper hole and the lower hole on the rotatable lever arm (126) and on the motor controlled arm (127) is countersunk on the same side. At this position, one end of the rod (128) is allowed to slide through the upper hole of the motor controlled arm (127) but another end of the rod (128) is bent down as a stopper which prevents any sliding to take place. The spring (129) is connected to the lower holes of the rotatable lever arm (126) and the motor controlled arm (127) is pulling the both arms together within the section of the rod (128) with the stopper. The spring (129) is in tension which help to pull both the rotatable lever arm (126) and the motor controlled arm (127) together at fixed distance given by the rod (128). The motor controlled arm (127) is connected to the micro-motor (135') beneath the cover plate (132). Once the mirco-motor (135') receives signal from the remote controller the motor controlled arm (127) pulls or pushes the spring load to provide the rotational movement of the writing instrument (160).

When the writing instrument (160) rotates anti-clockwise from its original position due to pile horizontal movement, the motor controlled arm (127) does not move but the rotatable lever arm (126) will move anti-clockwise smoothly under constant spring load. The motor controlled arm (127) can be rotated in vertical plane in both directions via the remote control pushing the writing instrument (160) to rotate anti-clockwise from 0° to 90° by the rod (128) and pulling the writing instrument (160) back from 90° to 0° by the spring (129).

In another embodiment of the present invention, the method for tracing the pile set during the pile driving comprises steps of: to attach the panel (110) preferably the graph paper to the pile (150). The platform (140) is clamped on a stable beam to support the sliding mechanism (130), so that the platform (140) does not move during the pile driving. The sliding mechanism (130) accommodates the holding mechanism (120) to hold the writing instrument (160) against the panel (150); Then, position the sliding mechanism (130) over the platform (140) at the extreme left position so that the writing instrument (160) traces the pile set across the panel (110) from left to right direction; and adjust the holding mechanism (120) fixed on the sliding mechanism (130) by means of the remote controller to trace the pile set for series of blows during the pile driving.

The invention claimed is:

1. A method for tracing a pile set during pile driving of a pile, comprising the steps of:

attaching the panel to the pile;

clamping a platform to a stable beam for supporting a sliding mechanism to accommodate a holding mechanism;

wherein the holding mechanism includes a holding tube to secure a writing instrument firmly by at least one adjusting means, and a shaft, wherein the shaft is engaged to a cylindrical block member, wherein the holding mechanism is operable to be rotated in a horizontal plane, wherein the holding tube includes a spring loaded mechanism received therein to urge the writing instrument against the panel;

positioning the sliding mechanism over the platform at an extreme left position by using remote controlling means or automatic controlling means; and rotating the holding mechanism fixed on the sliding mechanism by using the remote controlling means or the automatic controlling means to trace the pile set for a series of blows during the pile driving;

wherein the cylindrical block member is secured to the shaft by at least one adjusting means and a rotatable lever arm is secured to cylindrical block member by an adjusting means to allow the rotatable lever arm to rotate freely.

2. An apparatus for tracing a pile set during pile driving of a pile, comprising:

a panel for attachment to the pile;

a writing instrument;

a cylindrical block member;

a holding mechanism for holding the writing instrument against the panel to trace the pile set for a series of blows during the pile driving, wherein the holding mechanism includes a holding tube to secure the writing instrument firmly by at least one adjusting means, and a shaft, wherein the shaft is engaged to the cylindrical block member, wherein the holding mechanism is operable to be rotated in a horizontal plane, wherein the holding tube includes a spring loaded mechanism received therein to urge the writing instrument against the panel;

a sliding mechanism to provide lateral movement across the panel for the holding mechanism after every blow during the pile driving; and a platform for allowing the sliding mechanism to slide freely in a horizontal direction;

wherein movement of the sliding mechanism and the rotation of the holding mechanism is controlled via a remote controlling means or an automatic controlling means;

wherein the cylindrical block member is secured to the shaft by at least one adjusting means and a rotatable lever arm is secured to cylindrical block member by an adjusting means to allow the rotatable lever arm to rotate freely.

3. The apparatus according to claim 2, wherein the rotatable lever arm is linked to a micro-motor by a rod and a spring to provide rotation to the holding mechanism.

4. The apparatus according to claim 3, wherein the automatic controlling means is by a pressure sensor installed at the spring and a vibration sensor installed beneath the sliding mechanism.

5. The apparatus according to claim 4, wherein the pressure sensor and the vibration sensor transmit information back to the remote controlling means to provide movement to the sliding mechanism and rotation of the holding mechanism.

6. The apparatus according to claim 2, wherein the movement of the sliding mechanism is provided by a rack gear installed on the sliding mechanism, a spur gear and a micromotor installed on a wall of the platform.

7. The apparatus according to claim 2, wherein the adjusting means is a screw.

8. The apparatus according to claim 2, further comprising a camera for monitoring the rotation of the holding mechanism and the movement of the sliding mechanism.

9. The apparatus according to claim 2, wherein the remote controlling means further comprises a liquid crystal display monitor, for displaying the rotation of the holding mechanism and the movement of the sliding mechanism.

* * * * *